US005811922A

United States Patent [19]

Yi

[11] Patent Number: 5,811,922

[45] Date of Patent: Sep. 22, 1998

[54] COMA-ERROR CORRECTING MEANS OF CRT

[75] Inventor: Jae Hwang Yi, Seoul, Rep. of Korea

[73] Assignee: LG Electronics Inc., Seoul, Rep. of Korea

[21] Appl. No.: 576,213

[22] Filed: Dec. 21, 1995

[30] Foreign Application Priority Data

Dec. 23, 1994 [KR] Rep. of Korea ..... 36306/1994

[51] Int. Cl.[6] ..... H01J 29/70; H01J 29/46; H01H 85/22; H01H 85/48

[52] U.S. Cl. ..... 313/440; 313/442; 335/210; 335/213

[58] Field of Search ..... 313/412, 413, 313/421, 430–31, 433, 440, 442; 335/210, 213, 297, 299

[56] References Cited

U.S. PATENT DOCUMENTS 4,689,525 8/1987 Shimoma et al. ..... 313/412 X
4,723,094 2/1988 Shimoma et al. ..... 313/412
4,725,763 2/1988 Okuyama et al. ..... 313/412 X
4,962,333 10/1990 Sluyterman ..... 313/413 X
5,179,319 1/1993 Iwasaki et al. ..... 313/431 X

*Primary Examiner*—Sandra L. O'Shea
*Assistant Examiner*—Mack Haynes
*Attorney, Agent, or Firm*—Fish & Richardson P.C.

[57] ABSTRACT

A coma-error correction means of a deflection yoke is disclosed, in which a ferrite core wound with a vertical deflection coil is mounted on the periphery of a coil separator by a core clamp, a neck portion is extended from the top of the coil separator and attached with a coma-error correcting means at its horizontal surface, and a screen portion is extended from the bottom of the coil searator, wherein said coma-error correcting means includes a correction magnetic plate, two correction iron pieces serving as mounting surfaces and integrally formed at the end parts of the correction magnetic plate, and a coma-error correction coil wound on the top of the correction magnetic plate.

4 Claims, 8 Drawing Sheets

F. I G.3
prior art
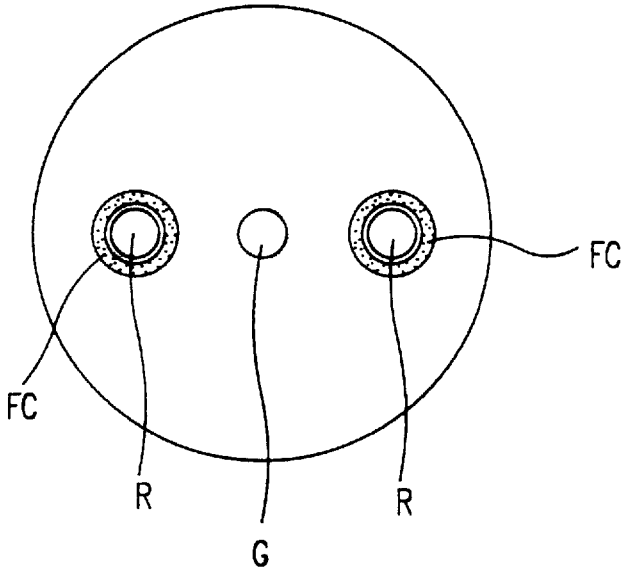

COMA-ERROR CORRECTING MEANS OF CRT

BACKGROUND OF THE INVENTION

The present invention relates to a Cathode Ray Tube (CRT), and more particularly, to a coma-error correcting means of a deflection yoke in which a predetermined shape of correcting means wound with a coma-error correcting coil is mounted on the neck portion of a deflection yoke to correct a coma-error misconvergence which is a distortion error caused by the misconvergence of deflection.

Generally, the deflection yoke is to deflect electron beams emitted from an electron gun to precisely scan respective pixels of a screen by forming a certain magnetic field, and typically comprises a coil separator, a vertical deflection coil, a horizontal deflection coil, and a misconvergence correcting means.

The amount of local misconvergence is not proportional to a distance from the electron gun to the screen and becomes non-linear due to the planar and supersized screen. The misconvergence is displayed on the screen in the forms of landing errors, distortion errors and VCL (Vertical Center Laster) distortions.

To describe the misconvergence in more detail, the landing errors represent the misconvergence that the electron beams R, G, B emitted from the electron gun can not scan the respective pixels of the screen precisely and becomes inclined toward a center portion or edge portions of the screen, so that the screen becomes narrow or wide.

And, the distortion errors represent the barrel or pincushion type misconvergence of the screen that the electron beams R, G, B are scanned out of the top and bottom of the screen or concentratedly on the center portion of the screen while the edge portions of the screen are not scanned by the beams.

Further, the VCL distortion represents the misconvergence that the red and blue beams R and B are precisely scanned on the screen but the other green beams G are not precisely scanned for each pixel on the screen so that distortions are occurred in a vertical direction.

On the other hand, a deflection yoke mounted on the electron gun to scan the three electron beams of in-line arrangement adopted by the present invention to a color CRT (Cathode Ray Tube) deflects the electron beams vertically or horizontally for deflecting scanning lines to the corresponding positions of fluorescent faces. In this case, the magnetic convergence type the deflection yoke as above does not need a separate convergence circuit.

The magnetic convergence deflection yoke forms a pincushion type deflection magnetic field as shown in FIG. 1A by the horizontal deflection coil, and a barrel type deflection magnetic field as shown in FIG. 1B by the vertical deflection coil. The strength of the pincushion type horizontal deflection magnetic field and the barrel type vertical deflection magnetic field at the fluorescent side of the electron gun is shown in FIG. 1C.

In the manufacturing of the ;above deflection yoke, even though the misconvergence can be zero theoretically, the zero misconvergence value can not be realized due to the structure of the CRT and the characteristics of the deflection yoke. Therefore, various types of misconvergence occur in reality.

Referring to FIG. 2, a typical misconvergence in case of the vertical deflection is the coma-error. The coma-error occurs due to the barrel type magnetic field generated at the neck portion of the deflection yoke as shown in FIG. 2B, since the green beams G has less deflection amount than the red beams R and the blue beams B.

In the barrel type magnetic field, the magnetic flux density is higher at the peripheral portions where the green and the blue beams R and B are located than the center portion where the green beams G are located, so that the deflection force ($F_G$) of the green beams G become smaller than than the deflection forces ($F_R$) and ($F_B$) of the red and blue beams R, and B, thereby the deflection can not be achieved as much as the difference of the deflection forces and the coma-error occurs.

Therefore, as shown in FIG. 3, in order to correct the coma-error in the vertical direction, magnetic substances (FC) and (EH) have been introduced to be respectively attached to the outlets of the red and blue beams R, and B. The magnetic substance (FC), that is, a field controller in the shape of ring is attached for surrounding the outlets of the red and blue beams R, and B of the electron gun to shut off the deflection field for the red and blue beams R and B, so that the red and blue beams R and B is less deflected tan when there is no magnetic substance(FC), thereby the relative-vertical deflection magnetic field for the green beams G becomes strong enough to correct the vertical comaerror.

The conventional coma-error correcting method as above has, however, still disadvantages that only a partial misconvergence can be prevented since the correction is performed by using the extremely weak leakage magnetic field generated at the neck portion of the deflection yoke.

Further, the deflection yoke of the above structure deteriorates the horizontal deflection force as well as the vertical deflection force for the red and blue beams R and B, and a high frequency current generated around the deflection yoke results in the emitting of heat in the magnetic substance.

SUMMARY OF THE INVENTION

Therefore, in order to overcome such problems, there is provided a coma-error correcting means of a deflection yoke in which the coma-error is corrected without a field controller by various shape of correcting coils wound around the neck portion of the deflection yoke.

To accomplish the object of the present invention, there is provided a coma-error correcting means of a deflection yoke in which a ferrite core wound with a vertical deflection coil is mounted on the periphery of a coil separator by a core clamp, a neck portion is extended from the top of the coil separator and attached with a coma-error correcting means at its horizontal surface, and a screen portion is extended from the bottom of the coil separator, wherein said coma-error correcting means comprises a correction magnetic plate, two correction iron pieces serving as mounting surfaces and integrally formed at the end parts of said correction magnetic plate, and a coma-error correction coil wound on the top of said correction magnetic plate.

BRIEF DESCRIPTION OF THE DRAWINGS

The invention will now be described by way of example with reference to the accompanying drawings, in which:

FIG. 3 is a view schematically showing a coma-error correction according to a prior art;

FIG. 4A is a side elevation view and, FIG. 4B is a front elevation view;

FIG. 8A is a front elevation view, and FIG. 8B is a perspective view;

FIG. 9A is a front elevation view, and FIG. 9B is a perspective view;

DETAILED DESCRIPTION OF THE PREFERRED EMBODIMENTS

Hereinafter, preferred embodiments of a coma-error correcting means of a deflection yoke will be described with reference to the attached drawings.

Figure 4A:
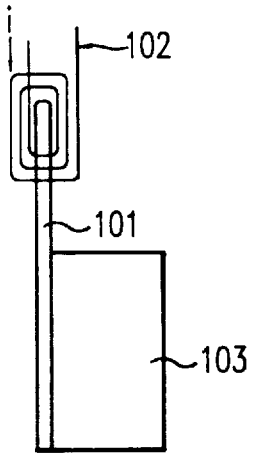
FIG. 4A~FIG. 4B are views for explaining a coma-error correcting means according to a preferred embodiment of the present invention.
Figure 4B:
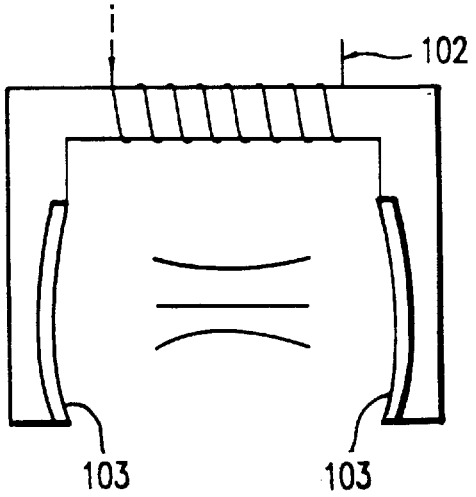

Referring to FIG. 4A~FIG. 4B, a coma-error correcting means according to a preferred embodiment of the present invention is illustrated. In FIG. 4A, a coma-error correcting means of a deflection yoke comprises a correction magnetic plate (101) in an inverted U-shape, a correction coil (102) wound around the top of the magnetic plate (101), and a pair of concave ring-shaped correction iron pieces (103) integrally attached to the inverted U-shaped correction plate (101).

According to a first embodiment as shown in FIG. 4B, if a certain current is supplied to the coil (102) wound on the top of the integral correction plate (101) and the correction iron pieces (103), induced electromotive force is generated and the correction plate (101) and the correction iron pieces (103), being formed concavely in the shape of an arc of a circle and attached to the magnetic plate (101) at both end portions symmetrically.

Figure 5:
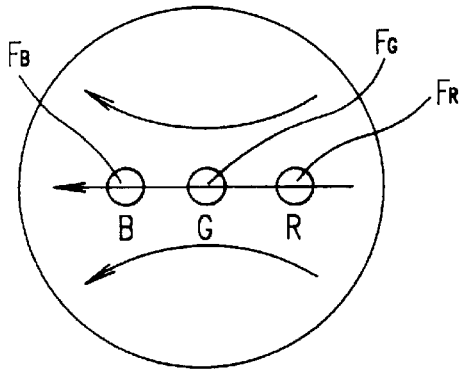
FIG. 5 is a view showing a horizontal deflection field in the coma-error correction according to the present invention.

If a deflection current (i) synchronized with a vertical deflection coil is applied to the correction coil (102), strong magnetic fields are generated between the pair of magnetized correction iron pieces (103) facing each other, and the magnetic fields generate a pincushion type vertical deflection field as shown in FIG. 5 since the magnetic field is concentrated on the center portion between the correction iron pieces (103) due to their concave shape.

The magnetic flay of the pincushion type vertical magnetic field formed between the correction iron pieces (103) as shown in FIG. 5 has high density at its central position of beam G and low density at its peripheral positions of beams R and B.

Figure 1A:
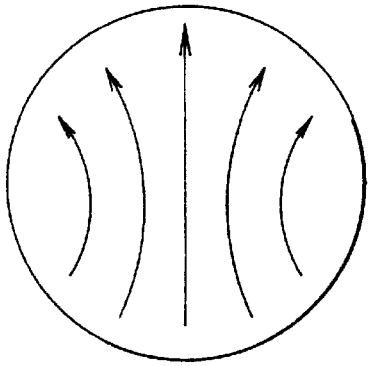
FIG.1A conventional art
FIG. 1A~FIG. 1C are views respectively showing the conventional vertical and horizontal deflection fields.
Figure 1B:
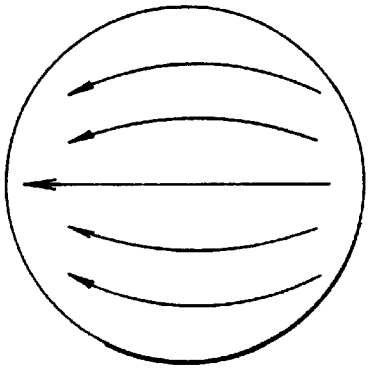
FIG.1B conventional art
Figure 1C:
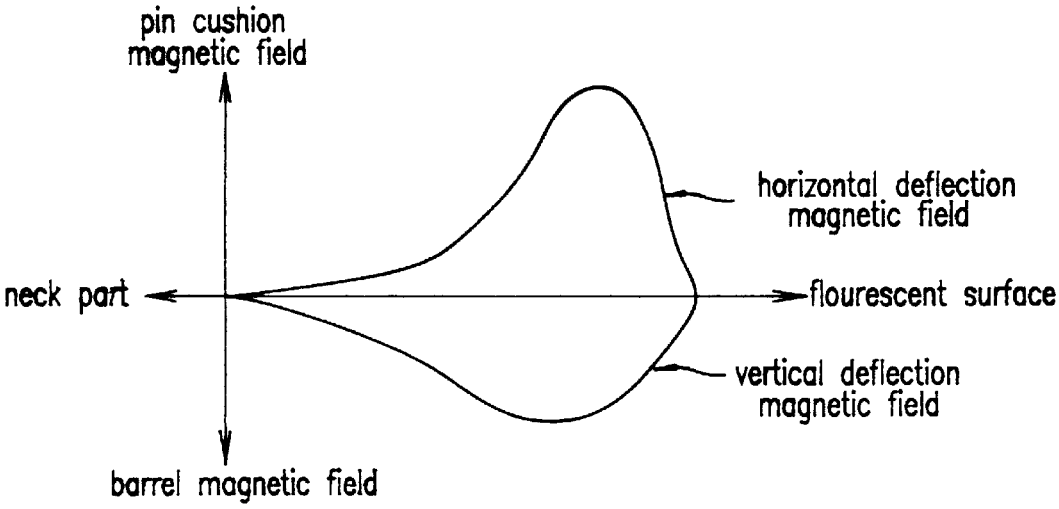
FIG.1C conventional art
Figure 2A:
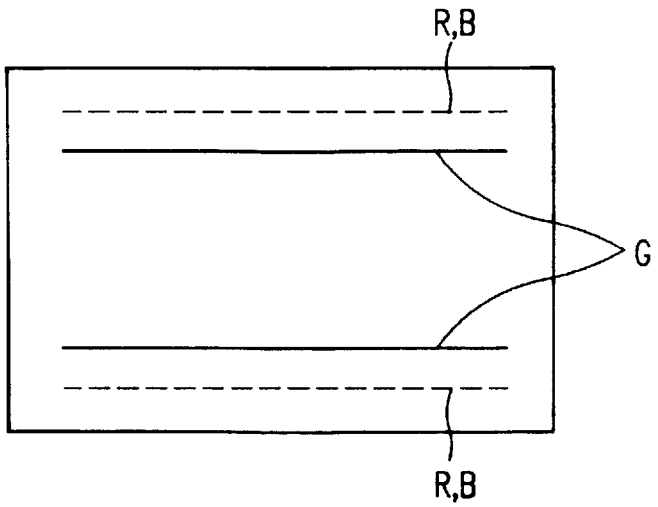
FIG.2A conventional art
FIG. 2A and FIG. 2B are views respectively illustrating the misconvergence states of a conventional deflection yoke.
Figure 2B:
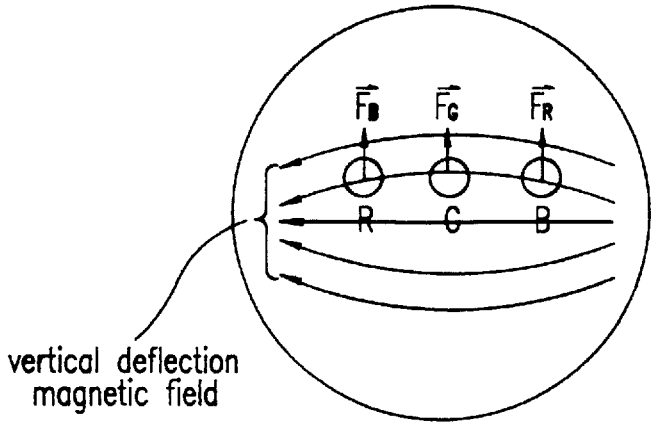
FIG.2B conventional art

Therefore, the vertical deflection force ($F_G$) of the beams G becomes larger than those ($F_B$) and ($F_R$) of the beams R and B, so that the beams G in the center position can be deflected more than the beams R and B and continuously passing through the magnetic convergence type deflection yoke, so as to correct the vertical coma-error as shown in FIG. 2A.

Figure 6A:
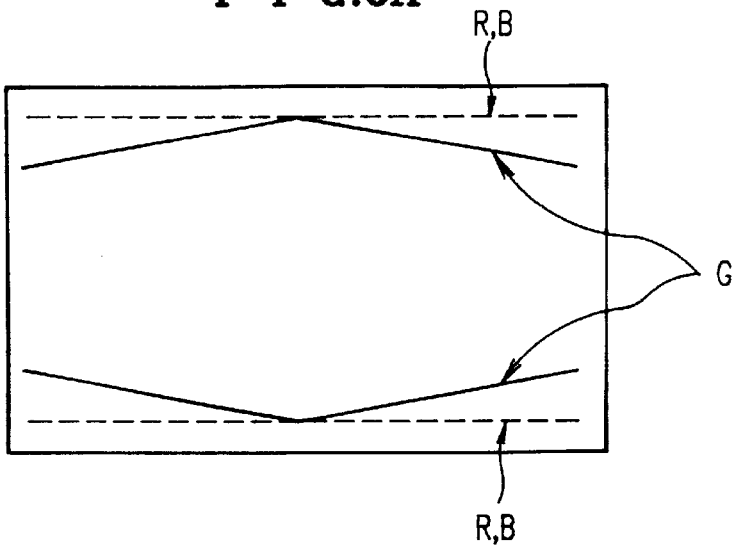
FIG. 6A is a view showing the characteristics of a screen in case of misconvergence.
Figure 6B:
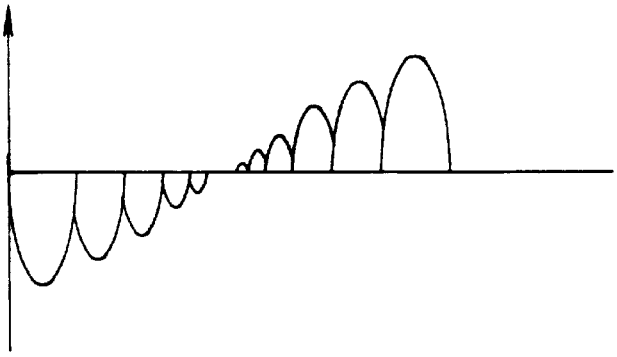
FIG. 6B is a view showing a wave form of a convergence current.

In the coma-error correcting means according to the first embodiment, the vertical coma-error can be corrected by adjusting the convergence amount under the control of the applied current amount applying to the correction coil 102 as shown in FIG. 6B.

Figure 7A:
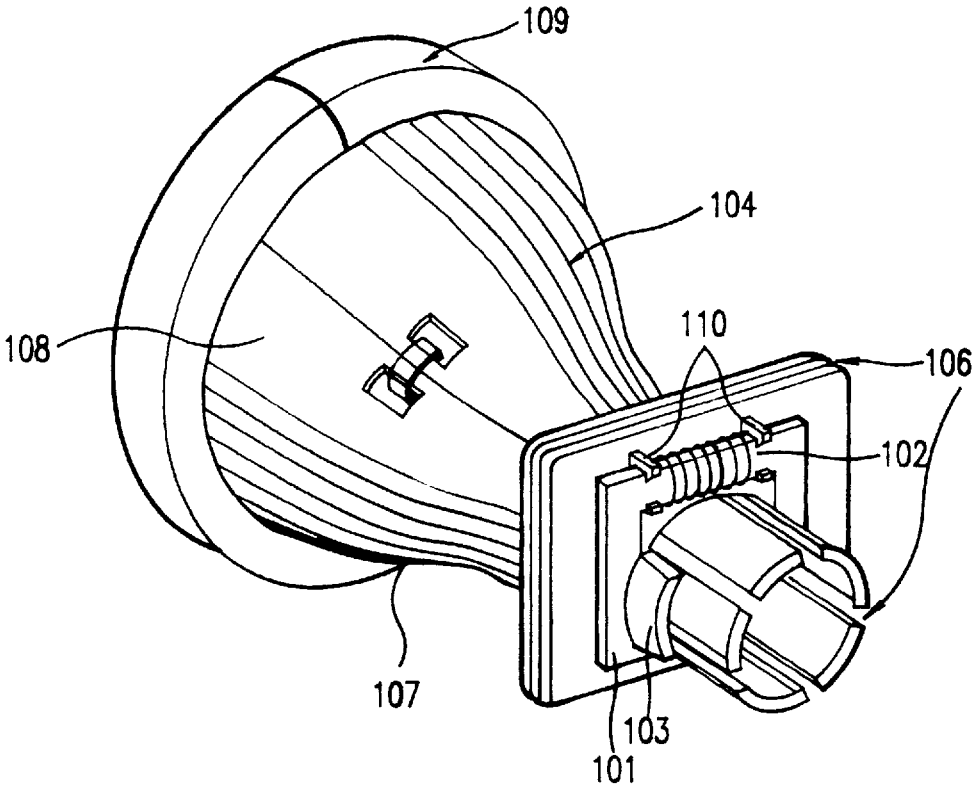
FIG. 7A is a perspective view of a deflection yoke adopting the coma-error correcting means according to the present invention.
Figure 7B:
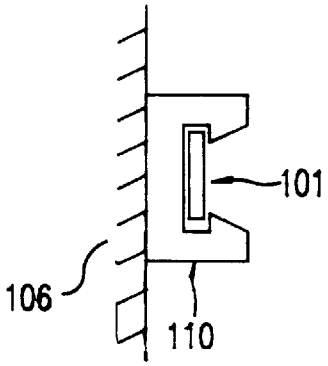
FIG. 7B is a view showing a supporter according to the present invention.

Referring to FIG. 7A, in the deflection yoke, a ferrite core (108) wound with a vertical deflection coil (104) is mounted on the periphery of a coil separator (109) by a core clamp (107), a neck portion (106) is extended from the top of the coil separator (109), and a screen portion is extended from the bottom of the coil separator (109), where the coma-error correcting means is adapted to a horizontal surface of the neck portion (106) by the support bar 110 in FIG. 7B.

The coma-error correcting means comprises a correction magnetic plate (101) having two mounting surfaces (103) integrally formed at both end parts thereof and wound with a coma-error correction coil (102) on the top thereof.

According to the geometrical shape of the screen and the magnetic fields made by the deflection yoke, the coma-error results in a much complicated shape as shown in FIG. 6A rather than the simple one as shown in FIG. 2A, where the vertical coma-error as shown in FIG. 6A is impossible to correct by means of the field controller which utilizes the leakage magnetic field of the deflection yoke.

Therefore, in the first embodiment of the present invention, a parabolic correction current is applied to the correction coil (102) in order to correct such a complicated coma-error, as shown in FIG. 6B.

Figure 8A:
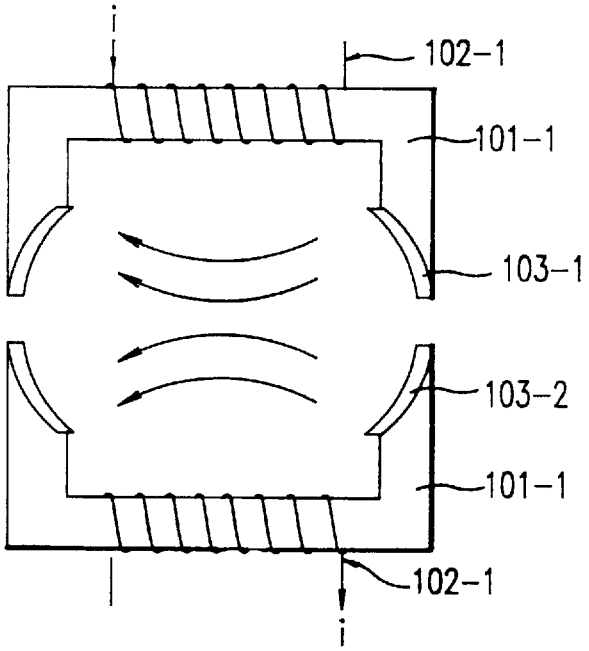
FIG. 8A and FIG. 8B are views respectively for explaining a coma-error correcting means of a deflection yoke according to a second preferred embodiment of the invention.
Figure 8B:
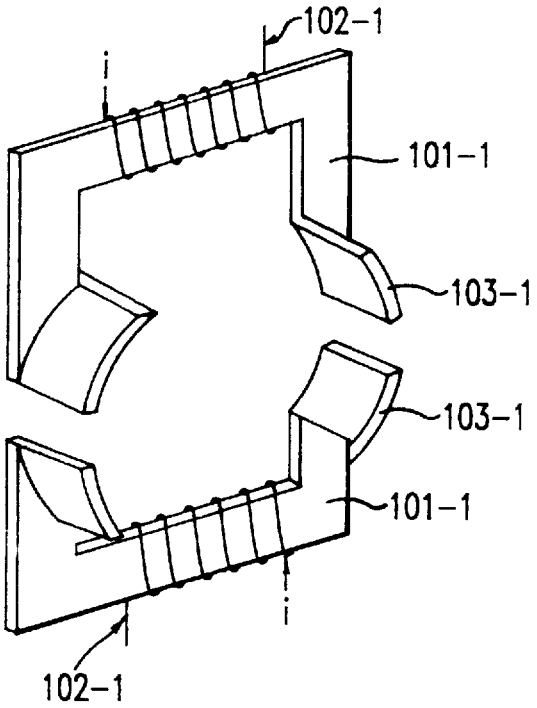
Figure 9A:
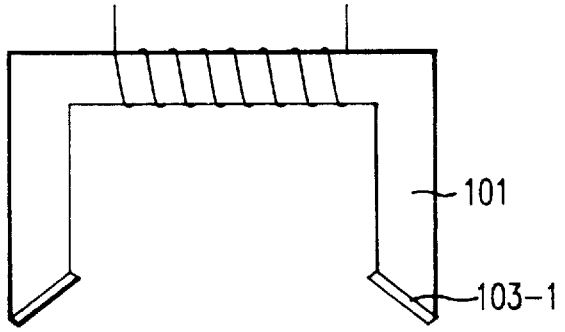
FIG. 9A and FIG. 9B are views respectively for explaining a coma-error correcting means of a deflection yoke according to a third preferred embodiment of the invention.
Figure 9B:
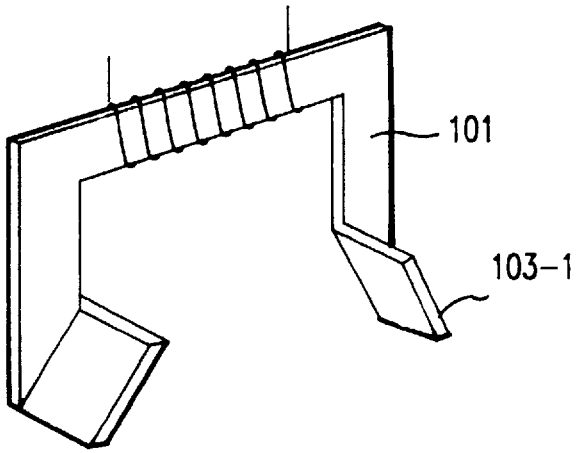

FIG. 8A and FIG. 8B are views respectively for explaining a coma-error correcting means of a deflection yoke according to a second preferred embodiment of the invention, FIG. 9A and FIG. 9B are views respectively for explaining a coma-error correcting means of a deflection yoke according to a third preferred embodiment of the invention.

To describe the second embodiment of the present invention in more detail, the correction iron pieces (103) of FIG. 4 are divided into two pairs of correction iron pieces (103-1), (103-2) to be attached to the correction plates (101-1), (101-2), where the top and the bottom of the magnetic plates (101-1), (101-2) are respectively wound with correction coils (102-1), (102-2) to generate the induced electromotive forces. The pincushion type vertical deflection magnetic field can be adjusted by controlling a distance between the two pairs of correction iron pieces (103-1), (103-2).

In order to realize the second embodiment of the present invention, a coma-free correcting means comprising the correction magnetic plate (101) integrally formed with two mounting surfaces (103) and wound with the coma-error correction coil (102) on the top thereof is mounted on the neck portion (106) of the deflection yoke as shown in FIG. 7.

Referring to FIG. 9, the third embodiment of the present invention is described in more detail, where the coma-free correcting means according to the third embodiment comprises planar correction iron pieces (103-3) without any curvature instead of the concave correction iron pieces (103-1), (103-2) as shown in FIG. 8 to simplify the structure thereof.

As described above, according to the present invention, the coma-error correcting means is mounted on the plane surface of the neck portion of a deflection yoke and comprises a correcting magnetic plate having two mounting surfaces integrally formed at both end parts and wound with a coma-error correction coil on the top thereof, so as to effectively correct the vertical coma-error which is caused by the barrel type magnetic field generated at the neck portion of the magnetic convergence deflection yoke, where the deflection yoke comprises a ferrite core wound with a vertical deflection coil and mounted on the periphery of a coil separator by a core clamp, the neck portion extended from the top of the coil separator, and a screen portion extended from the bottom of the coil separator.

What is claimed is:

1. A coma-error correcting means of a deflection yoke, wherein the deflection yoke includes a coil separator, a ferrite core wound with a vertical deflection coil and mounted on a periphery of the coil separator by a core clamp, the coma-error correcting means, a neck portion extended from a top of the coil separator and attached to the coma-error correcting means at a horizontal surface of the correcting means, and a screen portion extended from a bottom of the coil separator, wherein said coma-error correcting means comprises:

a correction magnetic plate having a central portion and legs extending from ends of the central portion;

two correction iron pieces serving as mounting surfaces and integrally formed at ends of the legs of said correction magnetic plate opposite the central portion of the correction magnetic plate; and a coma-error correction coil wound about the central portion of said correction magnetic plate in a direction substantially parallel to a direction from which said legs extend from the ends of the central portion.

2. The coma-error correcting means of a deflection yoke according to claim 1, wherein the two correction iron pieces of the correction magnetic plate are formed in a ring-shape.

3. The coma-error correcting means of a deflection yoke according to claim 2, wherein the correction iron pieces of the correction magnetic plate are formed in a concave-shape.

4. A coma-error correcting means of a deflection yoke, wherein the deflection yoke includes a coil separator, a ferrite core wound with a vertical deflection coil and mounted on a periphery of the coil separator by a core clamp, the coma-error correcting means, a neck portion extended from a top of the coil separator and attached to the coma-error correcting means at a horizontal surface of the correcting means, and a screen portion extended from a bottom of the coil separator, wherein said coma-error correcting means comprises:

a pair of correction magnetic plates, each having a central portion and legs extending from ends of the central portion;

four correction iron pieces serving as mounting surfaces and integrally formed at ends of the legs of said correction magnetic plates opposite the central portions of the correction magnetic plates; and a coma-error correction coil wound about the central portions of the correction magnetic plates in a direction substantially parallel to a direction from which said legs extend from the ends of the central portions.

* * * * *